United States Patent [19]

Matoba et al.

[11] Patent Number: 4,637,786

[45] Date of Patent: Jan. 20, 1987

[54] SCROLL TYPE FLUID APPARATUS WITH LUBRICATION OF ROTATION PREVENTING MECHANISM AND THRUST BEARING

[75] Inventors: Yoshiaki Matoba; Hitoshi Ozawa, both of Sakai, Japan

[73] Assignee: Daikin Industries, Ltd., Osaka, Japan

[21] Appl. No.: 745,227

[22] Filed: Jun. 17, 1985

[30] Foreign Application Priority Data

| | | | |
|---|---|---|---|
| Jun. 20, 1984 | [JP] | Japan | 59-127184 |
| Jun. 23, 1984 | [JP] | Japan | 59-93973[U] |
| Jun. 23, 1984 | [JP] | Japan | 59-93974[U] |
| Apr. 10, 1985 | [JP] | Japan | 60-76108 |

[51] Int. Cl.[4] ..... F01C 1/04; F01C 21/04; F16D 3/04; F16N 1/00

[52] U.S. Cl. ..... 418/55; 418/88; 418/94; 464/7; 464/102

[58] Field of Search ..... 418/55, 88, 94; 464/7, 464/102

[56] References Cited

U.S. PATENT DOCUMENTS 1,576,089 3/1926 Burns ..... 464/7

FOREIGN PATENT DOCUMENTS 55-43217 3/1980 Japan ..... 418/55

*Primary Examiner*—John J. Vrablik

*Attorney, Agent, or Firm*—Stevens, Davis, Miller & Mosher

[57] ABSTRACT

A scroll type fluid apparatus having a rotation preventing mechanism provided with a sliding member engageable with the outer surface of a bearing portion at an orbiting scroll and regulating the radial movement of the sliding member in reciprocating movement, and a sliding member holder engageable with the outer surface of the sliding member so as to regulate the movement of the sliding member in the direction perpendicular to the moving direction of the bearing portion. Spaces formed before and behind the sliding member in the sliding direction thereof are utilized as oil chambers respectively, whereby lubricating oil pumped-up from an oil pickup provided at a crankshaft is forcibly fed by the pump action caused by sliding motion of the sliding member onto the slidable contact surface of a thrust bearing supporting the orbiting scroll.

7 Claims, 11 Drawing Figures

SCROLL TYPE FLUID APPARATUS WITH LUBRICATION OF ROTATION PREVENTING MECHANISM AND THRUST BEARING

FIELD OF THE INVENTION

This invention relates to a scroll type fluid apparatus, and more particularly to a scroll type fluid apparatus provided with a fixed scroll, an orbiting scroll, a housing for fixing the fixed scroll, a thrust bearing through which the orbiting scroll is supported rotatably to the housing, a crankshaft having an eccentric shaft for driving the orbiting scroll, and a rotation preventing mechanism for preventing the orbiting scroll from rotating by itself.

DESCRIPTION OF THE PRIOR ART

A conventional scroll type fluid apparatus has hitherto been well-known which is provided with a fixed scroll and an orbiting scroll where in the orbiting scroll orbits with respect to the fixed scroll to thereby compress a compressible fluid, such as a refrigerant, for a refrigerator. Also, a rotation preventing mechanism provided in such scroll type fluid apparatus and for preventing rotation of the orbiting scroll has been desclosed in the Japanese Patent Publication No. Sho 58-10,585 as shown in FIG. 11.

The rotation preventing mechanism in FIG. 11 is so constructed that at the rear side of orbiting scroll B in engagement with a fixed scroll A are provided the following; a cylindrical bearing portion E engageable with an eccentric shaft D at a crankshaft C; a flange member F square at the outer surface and coupled integrally with the outer periphery of the bearing portion E; a sliding member G disposed outside the flange member F, having the inner surfaces engageable with two opposite outer surfaces at the flange member F respectively so as to regulate the radial movement thereof in reciprocation, and formed to be square at the outer surface; and a sliding member holder K having the inner surfaces engageable with two opposite outer surfaces at the sliding member G respectively so as to regulate the movement thereof in the direction perpendicular to the moving direction of the bearing member E.

In addition, in the same drawing, reference letter R designates a rotor which is fixed to the eccentric shaft D at the crankshaft C rotatably integrally therewith, supported to a fixing member S through a thrust bearing M, and carrying the flange member F through a thrust bearing N.

In the above construction, when the crankshaft C is driven, the regulation by the sliding member G of the movement of the bearing portion E and by the sliding member holder K of that of the sliding member G prevent the orbiting scroll B from rotating by itself. Hence, the orbiting scroll B orbits without its rotation to compress the fluid between the same and the fixed scroll A.

In the scroll type fluid apparatus constructed as described above, the orbiting scroll B is supported to the fixing member S through the flange member F, thrust bearing N, rotor R and thrust bearing M, but the conventional fluid apparatus is not provided with a lubrication means for the thrust bearings M and N even through they are subjected to a greater thrust load from the orbiting scroll B,resulting in that short lubrication for the thrust bearings M and N results in the risk of causing wearing or seizure thereat.

SUMMARY OF THE INVENTION

The inventors have paid attention in that the rotation preventing mechanism for the orbiting scroll by use of the sliding member and the holder therefor forms the spaces between the sliding member and the holder therefor and before and behind the sliding member in the sliding direction thereof, the spaces being variable in volume by the sliding motion of the sliding member driven by the crankshaft. Therefore, the spaces are utilized as oil chambers so as to carry out pump action when the sliding member slides, thereby lubricating a thrust bearing. An object of the invention is to provide a scroll type fluid apparatus simple in construction to lubricate the slidable contact surfaces of the thrust bearing and orbiting scroll by means of pump action to thereby solve the problem of insufficient lubrication for the thrust bearing.

The scroll type fluid apparatus of the present invention is provided with a fixed scroll, an orbiting scroll, a housing for fixing the fixed scroll, a thrust bearing for supporting the orbiting scroll rotatably to the housing, a crankshaft having an eccentric shaft for driving the orbiting scroll, and a rotation preventing mechanism for preventing the orbiting scroll form rotating by itself. The rotation preventing mechanism comprises a bearing portion provided at the rear side of the orbiting scroll, having a socket for receiving therein the eccentric shaft, and made square at the outer surface; a sliding member having the inner surfaces engageable with two opposite outer surfaces of the bearing portion respectively so as to regulate the radial movement thereof in reciprocating movement, and made square at the outer surface; and a sliding member holder having the inner surfaces engageable with two opposite outer surfaces of the sliding member respectively so as to regulate the movement of the sliding member in the direction perpendicular to the moving direction of the bearing portion. The crankshaft is provided with a lubrication means for lubricating the bearing portion, and sealed oil chambers variable in volume by sliding motion of the sliding member are provided before and behind the sliding member in the sliding direction thereof, the bearing portion and sliding member being provided with connection means for connecting the oil chambers with the lubrication means respectively. The thrust bearing is provided with communication means to communicate the slidable contact surface of the orbiting scroll with respect to the thrust bearing with the oil chambers.

In other words, the scroll type fluid apparatus of the invention is so constructed that the crankshaft is provided with lubrication means for lubricating the bearing portion, the bearing portion and sliding member are provided with connection means for connecting the lubrication means with the spaces formed before and behind the sliding member in the sliding direction thereof, the spaces are used as the oil chambers to utilize the variation in volume thereof caused by the sliding motion of the sliding member so that lubricating oil having been fed in the oil chambers is forcibly discharged therefrom by means of the pump action, and the thrust bearing is provided with communication means to communicate the oil chambers with the slidable contact surface of the orbiting scroll with respect to the thrust bearing , thereby enabling the oil discharged from the oil chambers by the sliding motion of the sliding member to be supplied thereto. Thus, the scroll type fluid apparatus can, even with simple construction, positively supply the oil in the oil chamber to the sliding portion at the thrust bearing so as to enable reliable and proper lubrication to the slidable contact surface, thereby preventing the occurrence of wearing or a seizure in the slidable contact surface.

In the present invention constructed as described above, it is preferable that a plurality of oil sumps each having a conical surface are provided at the slidable contact surface of the thrust bearing with respect to the orbiting scroll or of the orbiting scroll with respect to the thrust bearing. Also, the connection means and communication means are constituted mainly of oil-feeding passages, in which it is preferable that between the sliding member and the holder therefor are provided restriction mechanisms which, when the sliding member moves to reduce the volume of the oil chamber, suppress oil flow from the oil-feeding passage of the communication means to that of the connection means.

The oil in the oil chamber, when the volume of the oil chamber is reduced during the movement of the sliding member, is pressurized so that a gross of oil is desired to be supplied to the slidable contact surface at the thrust bearing from the oil-feeding passage at the communication means, but since one of the oil-feeding passages at the connection means is open in the oil chamber and also the other communicates with the oil chamber whose volume increases, part of the oil subjected to the pump action in the oil chamber leads to an escape therefrom into the oil-feeding passage at the connection means. Accordingly, the restriction mechanisms are provided between the sliding member and the holder therefor so as to suppress the flow of oil to the oil-feeding passages at the connection means, whereby when the oil chamber descreases in volume, the amount of oil to escape into the oil-feeding passage can be minimized, thereby increasing , to that extent, the amount of oil to be fed onto the slidable contact surface of the thrust bearing.

The above and further objects and novel features of the invention will be more fully apparent from the following detailed description when the same is read in connection with the accompanying drawings.

DETAILED DESCRIPTION OF THE INVENTION

Figure 1:
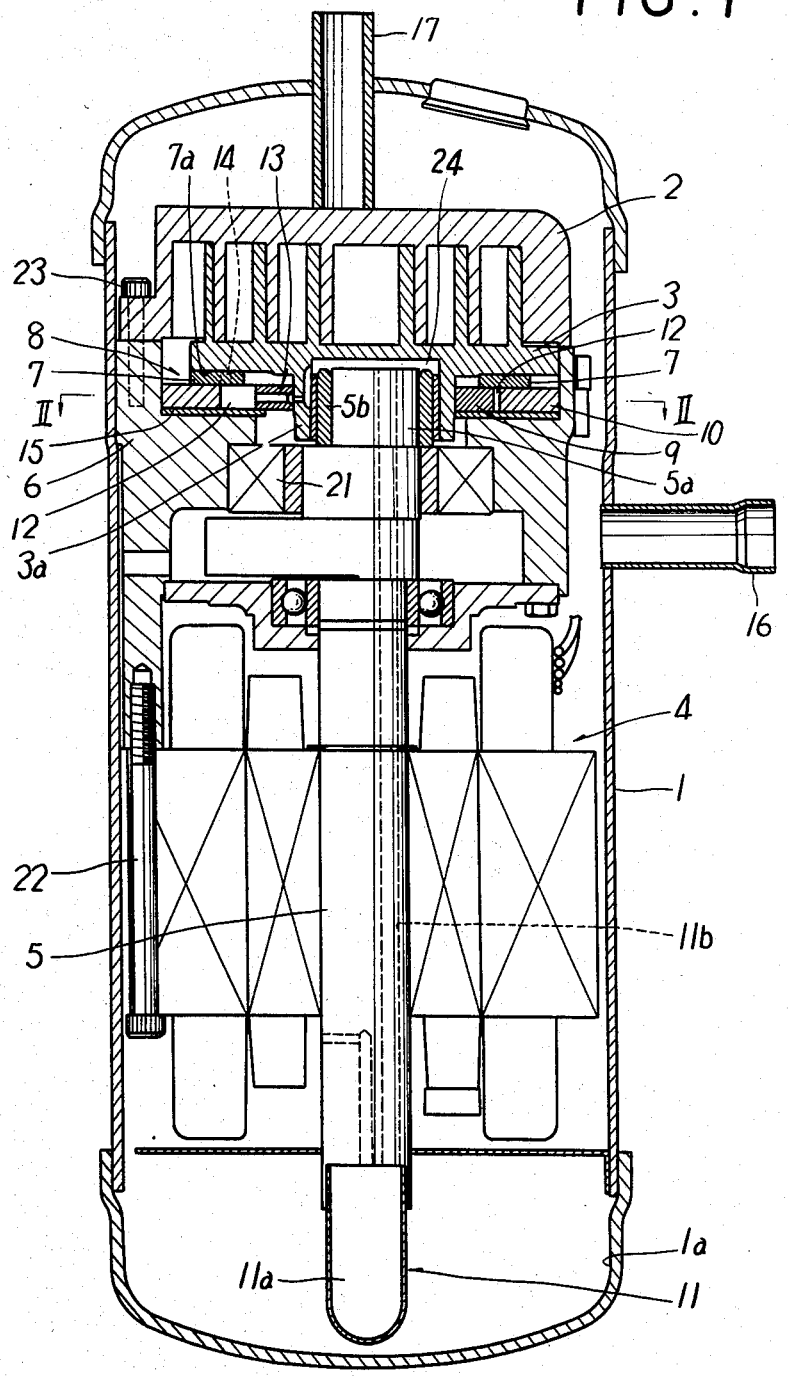
FIG. 1 is a longitudinal sectional view of an embodiment of a scroll type fluid apparatus of the invention.

A scroll type fluid apparatus shown in FIG. 1 is a compressor used for a refrigeration unit, which houses a fixed scroll 2 and an orbiting scroll 3 in the internally upper portion at a sealed casing 1 of vertical type. Casing 1 houses at the lower portion thereof a motor 4 and above the motor 4 a housing 6 supporting through a bearing 21 a crankshaft 5 connected to the motor 4.

The motor 4 and housing 6 are assembled with each other through a stay bolt 22 and incorporated in the casing 1 by press-fitting and held in the predetermined height.

The fixed scroll 2 is fixed to the upper portion of housing 6 through a mounting bolt 23, the orbiting scroll 3 is disposed below the fixed scroll 2, an eccentric shaft 5*a* at the crankshaft 5 is fitted into a cylindrical bearing portion 3*a* projecting from the rear surface of orbiting scroll 3, a thrust bearing 7 is interposed between the rear surface of orbiting scroll 3 and a sliding member holder 10 of a rotation preventing mechanism 8 to be discussed below, and the orbiting scroll 3 is supported rotatably to the housing 6 through the thrust bearing 7, the thrust bearing 7 shown in FIG. 1 being fixed to the sliding member holder 10. The rotation preventing mechanism 8 prevents the orbiting scroll 3 from rotating by itself when driven by the crankshaft 5, and is constructed as shown in FIG. 2.

Figure 2:
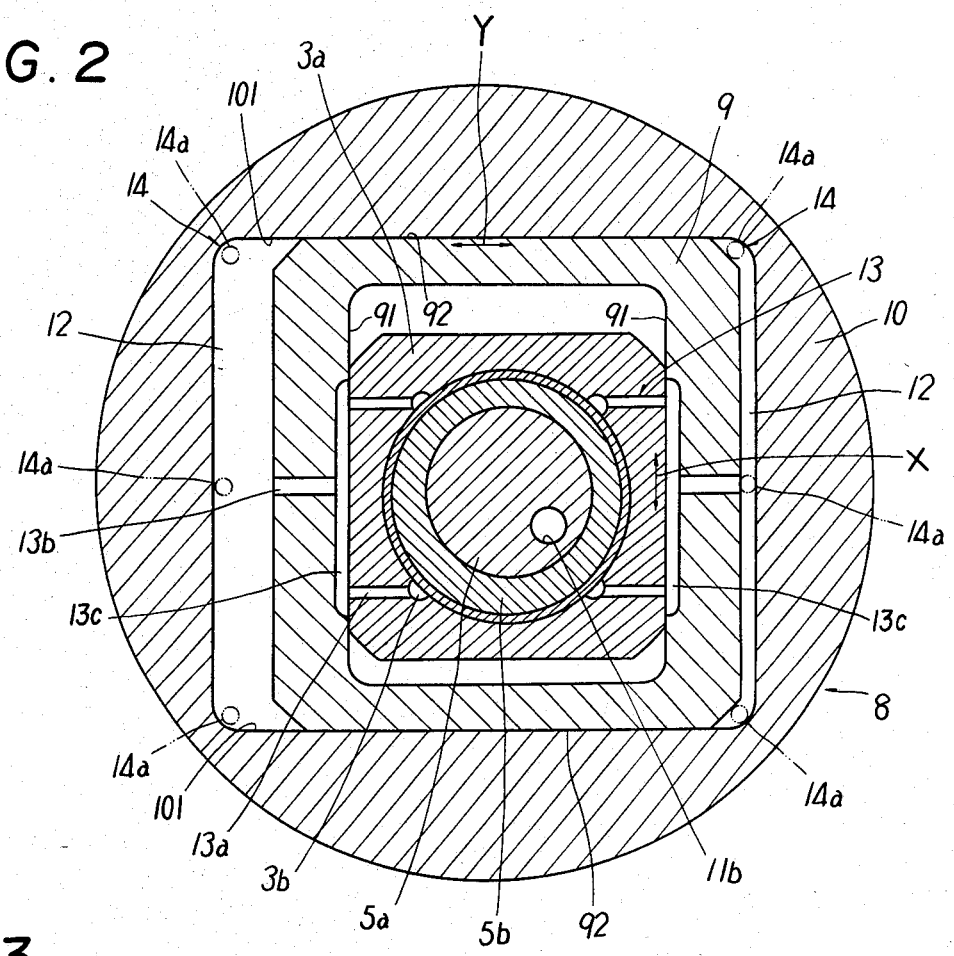
FIG. 2 is an enlarged sectional plan view taken on the line II—II in FIG. 1.
Figure 3:
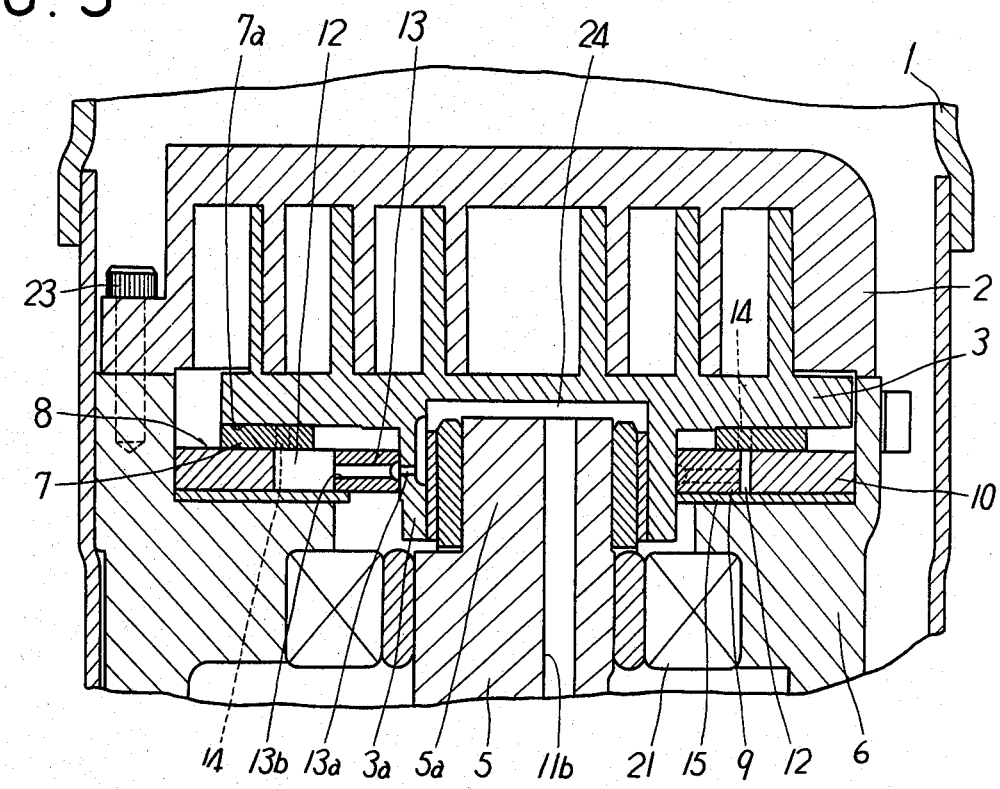
FIG. 3 is an enlarged longitudinal sectional view of the principal portion of the FIG. 1 embodiment.

Referring to FIG. 2, the bearing portion 3*a* at the orbiting scroll 3 is fitted onto the eccentric shaft 5*a* at the crankshaft 5 through a bush 5*b*, has at the center a socket having the inner surface for receiving thereon the bush 5*b*, and is made square at the outer surface.

A sliding member 9 is formed which has the inner surfaces 91 engageable with two opposite outer surfaces at the bearing portion 3*a* so as to regulate the radial movement of bearing portion 3*a* in the reciprocating direction (the directions of the arrows X) and which is formed to be square at the outer surface, and a sliding member holder 10 is formed which has the inner surfaces 101 engageable with two opposite outer surfaces 92 at the sliding member 9 so as to regualte the movement of sliding member 9 in the reciprocating direction (the directions of the arrows Y) perpendicular to that (the direction of the arrow X) of bearing portion 3*a*, so that combination of the bearing portion 3*a*, sliding member 9 and holder 10 therefor, constitutes the rotation preventing mechanism 8. Hence, when the crankshaft 5 is driven, the eccentric rotation of eccentric shaft 5*a* around the axis of crankshaft 5 and the operation of sliding member 9 and holder 10 therefor for regulating the movement of bearing portion 3*a* fitted onto the eccentric shaft 5*a* allow the orbiting scroll 3 to revolve with respect to the fixed scroll 2 without rotating by itself.

In the aforesaid construction, the spaces variable in volume by sliding motion of sliding member 9 are formed between the sliding member 9 and the holder 10 therefor and before and behind the sliding member 9 in the sliding direction thereof. This invention has been designed to utilize the spaces as oil chambers 12 to cary out forced lubrication from the oil chambers 12 onto the slidable contact surface 7*a* of thrust bearing 7 with respect to the orbiting scroll 3.

The crankshaft 5 is provided with a lubrication means 11 for lubricating the bearing portion 3*a* fitted onto the eccentric shaft 5*a*, the bearing portion 3*a* and sliding member 9 are provided with connection means 13 for connecting the oil chambers 12 with the lubrication means 11, and the thrust bearing 7 is provided with communication means 14 for communicating the oil chambers 12 with the slidable contact surface 7*a* at the thrust bearing 7 and that 3*b* at the orbiting scroll 3.

In greater detail, the oil chambers 12 utilizing the pair of spaces formed as above-mentioned , are closed below with a receiver plate 15 interposed between the sliding member 9 and the housing 6 and closed above with the thrust bearing 7 when the sliding member 9 moves forwardly.

The lubrication means 11 comprises an oil pickup 11*a* mounted on the lower end of crankshaft 5 and facing the oil sump 1*a* formed at the bottom of casing 1, and an oil-feeding conduit 11*b* perforating the crankshaft 5 axially thereof. The oil pickup action by the oil pickup 11*a* and the centrifugal pump action by the oil-feeding conduit 11*b* pump up the oil stored in the oil sump 1*a*, through the oil-feeding conduit 11*b* toward an oil-feeding space 24 formed between the upper end of eccentric shaft 5*a* and the inner surface of bearing portion 3*a*, thereby lubricating the slidable contact surfaces of the bearing portion 3*a* and eccentric shaft 5*a*.

The connection means 13 comprises two pairs of oil-feeding passage 13*a* formed at the bearing 3*a* and allowing the oi-feeding space 24 to communicate through the passages 13*a* with the slidable contact surfaces between the bearing portion 3*a* and the sliding member 9, and a pair of oil-feeding passages 13*b* formed at the sliding member 9 and each communicating at one end always with the passages 13*a* and at the other end with each oil chamber 12, so that the respective passages 13*a* and 13*b* are adapted to guide into each oil chamber 12 the oil to be fed to the eccentric shaft 5*a*. At inner surfaces 91 of sliding member 9 are formed grooves 13*c* in continuation of oil-feeding passages 13*b*. Grooves 13*c* extend in the direction of arrow X opposite to the outer surfaces of bearing portion 3*a* and assist oil-feeding passages 13*a* formed at bearing portion 3*a*, so that oil-feeding passages 13*a* are always connected with oil-feeding passages 13*b*.

Also, the communication means 14 comprises oil-feeding passages 14*a* formed at the thrust bearing 7 and communicating the slidable contact surfaces 7*a* at the thrust bearing 7 with the oil chambers 12 respectively, thereby positively feeding the oil in the oil chambers 12 by the sliding motion of sliding member 9 toward the slidable contact surface 7*a* through the oil-feeding passages 14*a*.

In addition, in FIG. 1, reference numeral 16 designates a fluid suction pipe, and 17 designates a fluid discharge pipe, so that the fluid is sucked into the casing 1 through the suction pipe 16 and compressed between the fixed scroll 2 and the orbiting scroll 3 and then discharged outwardly from the casing 1 through the discharge pipe 17.

The scroll type fluid apparatus of the invention is constructed as described above, in which the crankshaft 5 is driven by the motor 4 and rotates to allow the orbiting scroll 3 to revolve with respect to the fixed scroll 2 through the rotation preventing mechanism 8, thereby compressing the fluid between both the scrolls 2 and 3.

Now, lubricating oil is pumped up from the oil sump 1*a* through the lubrication means 11 following the rotation of crankshaft 5 and then fed into the oil-feeding space 24, and simultaneously, the sliding member 9 moves in reciprocation in the direction of the arrow Y in FIG. 2. When the sliding member 9 moves backwardly with respect to one oil chamber 12 and the volume thereof is enlarged, the oil is fed into the oil chamber 12 through the passages 13*a* and 13*b*.

On the other hand, the other oil chamber 12, to which the sliding member 9 moves forwardly, is tightly closed when the same enters between the thrust bearing 7 and the receiving plate 15, so that the pump action is generated as the volume of this chamber 12 decreases,-whereby the oil therein is fed for lubrication onto the slidable contact surface 7*a* at the thrust bearing 7.

Figure 4:
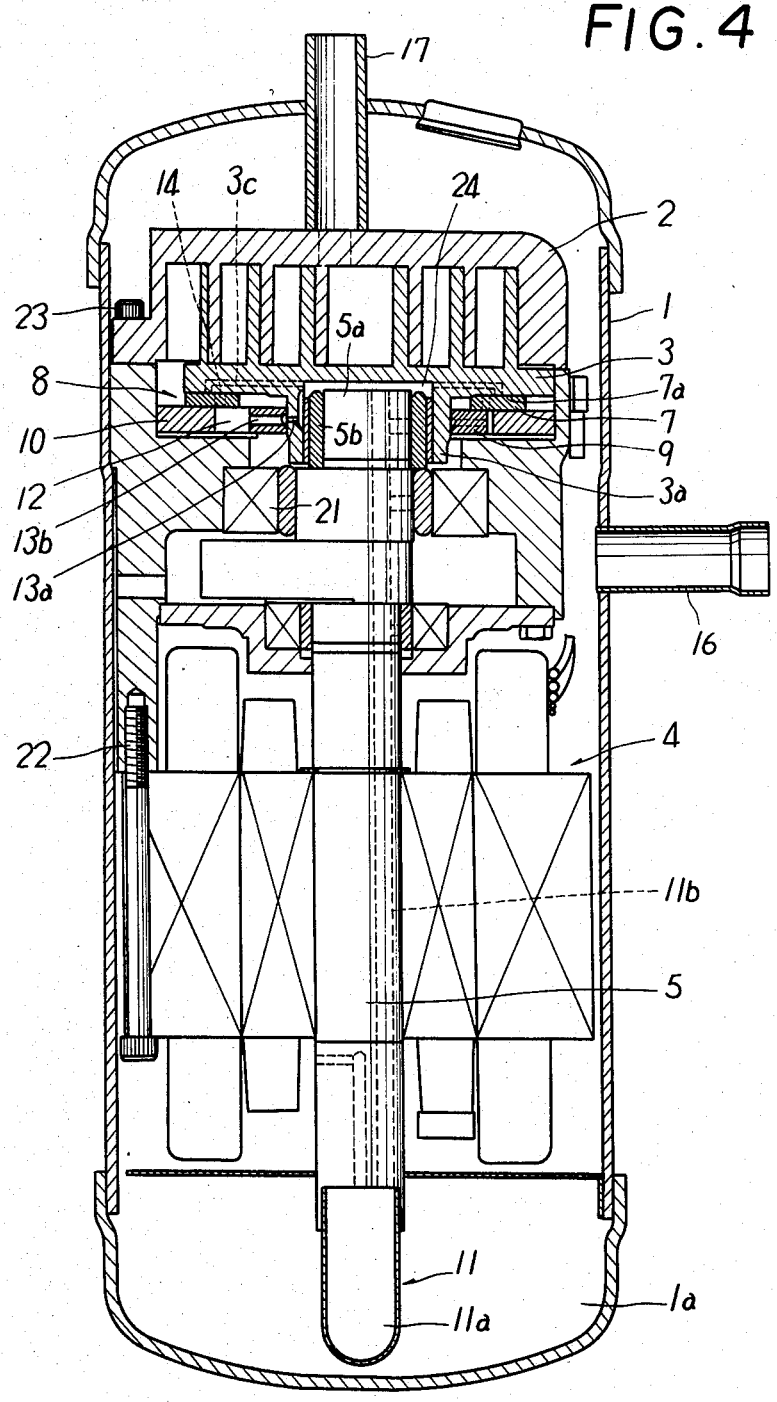
FIG. 4 is a longitudinal sectional view of a modified embodiment of the invention.

In a modified embodiment of the invention in FIG. 4, the orbiting scroll 3 is provided with oil-feeding passages 3*c* communicating the slidable contact surface 7*a* at the thrust bearing 7 with the oil feeding space 24 at the bearing portion 3*a*, so that the oil in the space 24, even when the sliding member 9 moves backwardly with respect to one oil chamber 12, is fed to the slidable contact surface 7*a* via the oil-feeding passages 3*c*, thereby lubricating the slidable surface 7*a*. Thus, the slidable contact surface 7*a* can always positively be lubricated regardless of the forward or backward movement of sliding member 9.

Figure 5:
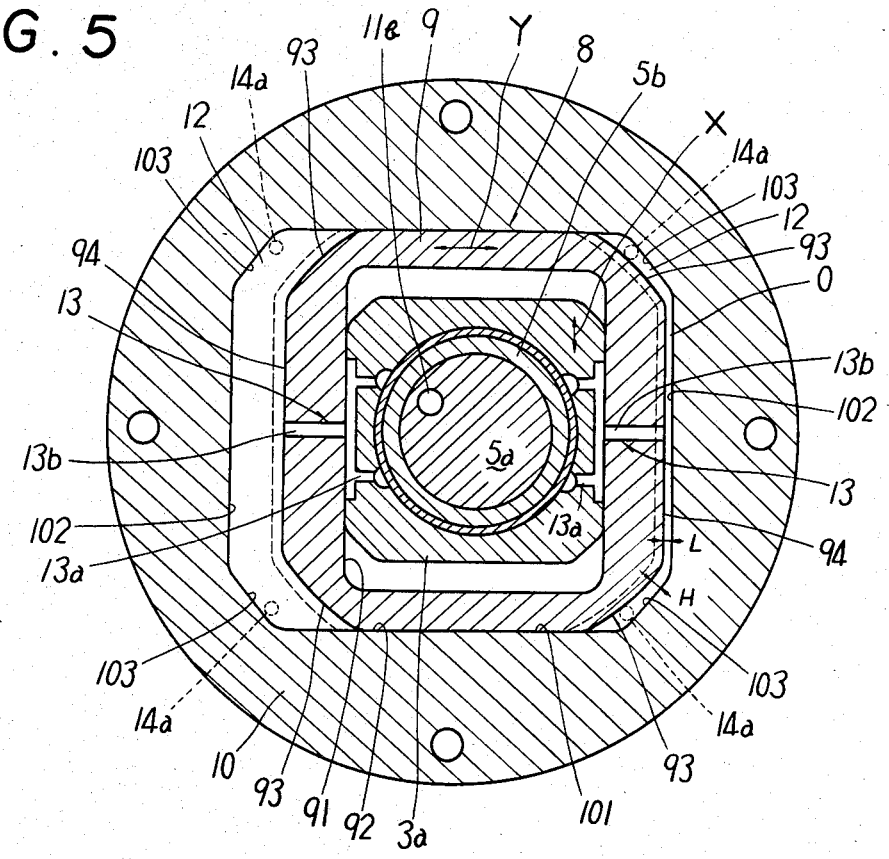
FIG. 5 is a sectional plan view of another modified embodiment of the invention, corresponding to FIG. 2.

Next, in another modified embodiment of the invention in FIG. 5, between the sliding member 9 and the holder 10 therefor are provided restriction mechanisms each for increasing an amount of oil fed from the oil chamber 12 to the slidable contact surface 7*a* at the thrust bearing 7 through the oil-feeding passages 14*a* and suppressing a flow of oil toward the respective oil-feeding passages 13*a* and 13*b* at the connection means 13.

In FIG. 5, the oil-feeding passages 14*a* provided at the thrust bearing 7 are disposed at both lateral sides in the moving direction of sliding member 9 in the oil chamber 12 respectively, the oil-feeding passages 13*b* of the connection means are disposed at the centers of both side walls of sliding member 9 in the moving direction thereof, cutouts 93 are provided at both lateral sides of sliding member 9 in the moving direction thereof, and the oil-feeding passages 14*a* are adapted to face the corners at each oil chamber 12, the corners each being depicted with the cutout 93 and an inclined inner surface 103 between the inner surface 101 and that 102 adjacent thereto at the holder 10 respectively.

In this construction, the outer surfaces 94 between the cutouts 93 at the sliding member 9 are opposite to the inner surfaces 102 at the holder 10 and project with respect to the cutouts 93 respectively, so that when the sliding member 9 moves forwardly, a restriction passage O, as shown at the right-hand side in FIG. 5, is formed between each outer surface 94 and each inner surface 102.

In other words, at the respective corners of each oil chamber 12 where the oil-feeding passages 14*a* are open , an interval H between each cutout 93 at the sliding member 9 and each inclined surface 103 at the holder 10, is made larger than that L between the outer surface 94 of sliding member 9 sandwiched by the cutouts 93 thereof and the inner surface 102 at the holder 10. When the pump action is carried out at the corner of oil chamber 12, the oil in the oil chamber 12 is intended to flow into the oil-feeding passage 13*b* at the connection means, but the oil is subjected to resistance by the restriction passage O, thereby being restrained from flowing into the oil-feeding passage 13*b* through the passage O. Hence, the amount of oil to be fed to the slidable contact surface 7*a* at the thrust bearing 7 can increase to that extent.

In further detail, when the sliding member 9 moves forwardly with respect to the oil chamber 12 and enters between the thrust bearing 7 and the receiving plate 15, the oil chamber 12 is tightly closed to start pressurization of lubricating oil in the oil chamber 12. However, since the oil chamber 12 communicates with the oil-feeding space 24 through the passages 13*a* and 13*b*, internal pressure in the oil chamber 12 rises not so much , resulting in that an amount of lubricating oil fed to the slidable contact surface 7*a* is relatively small for a while after the oil chamber 12 is closed by the sliding member 9.

When the sliding member 9 further moves forwardly and an interval between the outer surface 94 of sliding member 9 and the inner surface 102 of holder 10 opposite thereto becomes narrow, both the surfaces 94 and 102 form the restriction passage O to largely increase a resistance against the flow of oil in the restriction passage O and initiate demonstration of the restriction effect. In other words, the sliding member 9 moves forwardly from the position shown by the broken line to that shown by the solid line in FIG. 5, so that the oil in the oil chamber 12 at the oil-feeding passage 14 side is suppressed of its flow into the oil-feeding passages 13*a* and 13*b* and almost fed from the oil-feeding passage 14 to the slidable contact surface 7*a* at the thurst bearing 7.

Figure 6:
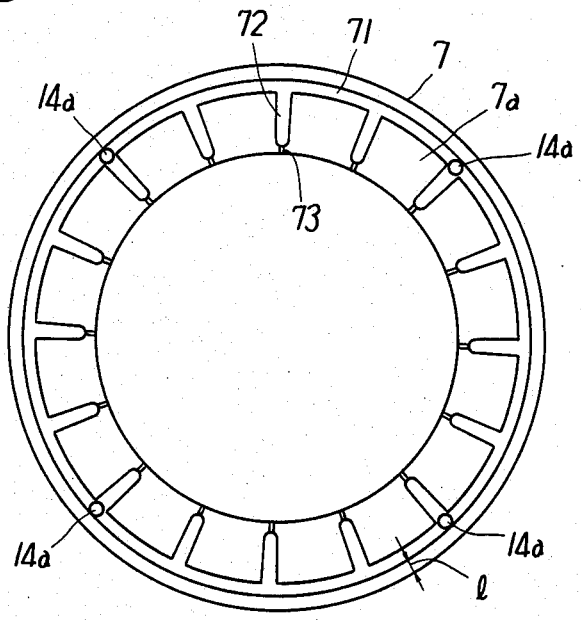
FIG. 6 is a plan view exemplary of a thrust bearing.

In addition, in the above-mentioned construction, the slidable contact surface 7*a* at the thrust bearing 7 is constructed as shown in FIG. 6, in which a first annular guide groove 71 is formed circumferentially of the slidable contact surface 7*a* and disposed radially inwardly from an annular slidable contact surface of width 1 at the outer periphery, and a plurality of second guide grooves 72 extend radially inwardly from the first guide groove 71. Also, V-notches 73 are provided at the radially inner ends of second guide grooves 72 and allow the inner ends thereof to be open radially inwardly of the thrust bearing 7, the oil-feeding passages 14*a* being open into the first guide groove 71.

Thus, lubrication from each oil-feeding passage 14*a* to the slidable contact surface 7*a* is carried out only intermittently corresponding to the forward and backward movements of sliding member 9, but imbalance from such lubrication can be suppressed by dispersing the lubricating oil circumferentially of the slidable contact surface 7*a* through the first guide groove 71. Furthermore, the oil fed therein is guided radially of the surface 7*a* overall through the second guide grooves 72, thereby enabling the lubrication to be uniform throughout the surface 7*a*.

Figure 7:
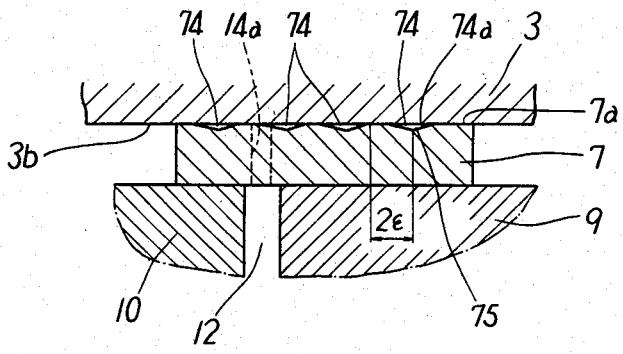
FIG. 7 is a partially sectional view exemplary of structure of a slidable contact surface at the thrust bearing of an orbiting scroll.
Figure 8:
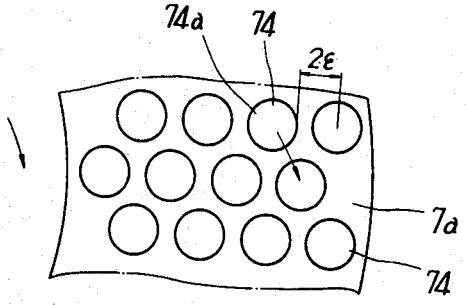
FIG. 8 is a partially plan view of the thrust bearing of construction in FIG. 7.
Figure 9:
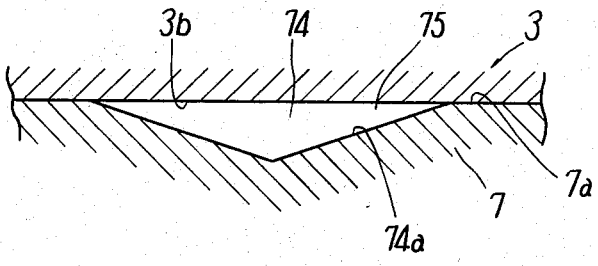
FIG. 9 is an enlarged sectional view of one oil sump in the construction in FIG. 7.

Alternatively, the thrust bearing 7 may, as shown in FIGS. 7 to 9, be provided at the slidable contact surface 7*a* with a number of conical oil sumps 74 instead of the guide grooves 71 and 72.

In this case, a distance between the respective adjacent oil sumps is made smaller than two times the revolving radius $\epsilon$ of the orbiting scroll 3. In FIGS. 7 and 8, a distance between the center of an optional oil sump 74 and the outer periphery of that adjacent thereto, is made smaller then $2\epsilon$.

Each oil sump 74 has a conical surface 74*a*, and between each conical surface 74*a* and the rear slidable contact surface 3*b* of the orbiting scroll 3 is provided a wedgeshaped space extending toward the overall outer periphery of oil sump 74.

When the orbiting scroll 3 is driven by the motor 4 and revolves, and optional point on the slidable contact surface 3*b* of the orbiting scroll 3 revolves (in circular motions) with a revolving radius thereof with respect to the slidable contact surface 7*a* at the thrust bearing 7, whereby the sliding direction of the orbiting scroll 3 with respect to each oil sump 74 varies sequentially.

Each oil sump 74 of conical surface 74*a*, even when the orbiting scroll 3 varies sequentially in the sliding direction with respect to each oil sump 74, forms the wedge-shaped space 75 always in the sliding direction of scroll 3. As a result, the lubricating oil in each oil sump 74 is thrust into the wedge-shaped space 75 to generate dynamic pressure on the lubricating oil film, whereby sufficient lubrication is continuously obtainable.

Moreover, since the distance between the respective oil sumps 74 is made smaller than two times the revolving radius $\epsilon$ of the orbiting scroll 3, the lubricating oil in a desired one oil sump 74 is transferred successively to the adjacent one as the orbiting scroll 3 revolves. Hence, the oil fed between the slidable contact surfaces 7*a* and 3*b*, while moving from one oil sump 74 to another, is discharged, after a while, from the slidable contact surfaces 7*a* and 3*b*. As a result, the lubricating oil is fed positively quickly to the slidable contact portions so as to improve its cooling effect thereon.

Alternatively, the oil sump 74 may be truncated conical, in brief, it need only be formed in the wedge-shaped space extending toward the whole outer periphery. Hence, the outer periphery of oil sump 74 may be elliptic.

Figure 10:
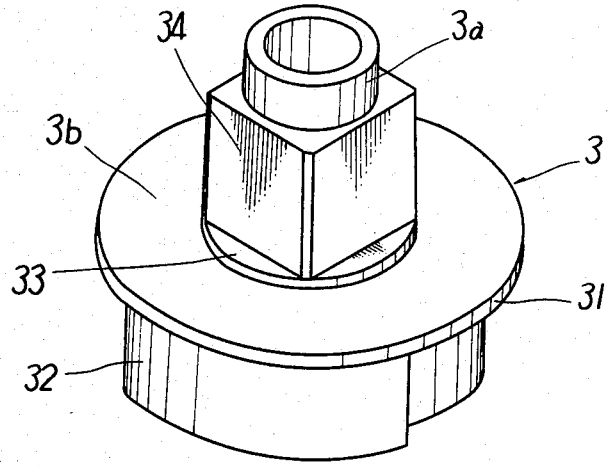
FIG. 10 is a perspective view of the orbiting scroll viewed from the rear side.
Figure 11:
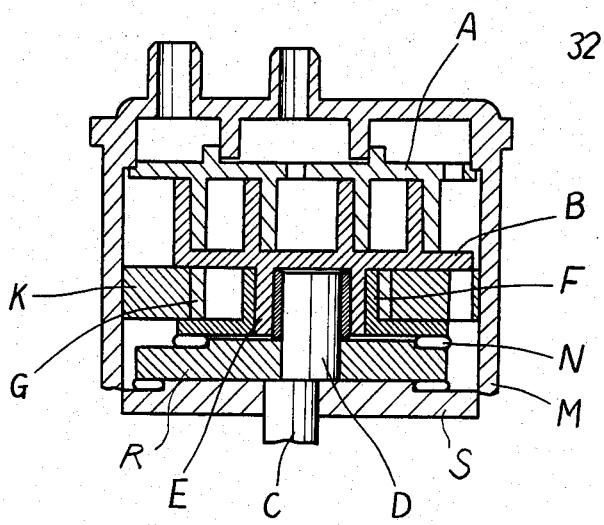
FIG. 11 (PRIOR ART)
FIG. 11 is a schematic longitudinal sectional view exemplary of a conventional scroll type fluid apparatus.

The orbiting scroll 3 is provided at one side of a base plate 31 with a spiral lap 32, at the rear of scroll 3 and the outer peripheral portion of base plate 31 with an annular slidable contact surface 3*b* for carrying the thrust bearing 7, and at the center of the rear surface with the bearing portion 3*a* having a receiving recess for receiving the eccentric shaft 5*a* and made square at the outer surface. Such orbiting scroll 3, as shown in FIG. 10, is preferable to be provided at the root of bearing portion 3*a* with a circular stepped portion 33 stepped with respect to the slidable contact surface 3*b*.

Hence, in a case where the orbiting scroll 3 is, for example, cast and the slidable contact surface 3*b*, after the casting, is lathe-machined (surfacing) and then the outer surface 34 of bearing portion 3*a* is finish-machined by a milling machine or the like, the bearing portion 3*a* is easy to machine because the root of the outer surface 34 is not restricted by the slidable contact surface 3*b* thanks to the stepped portion 33. Hence, there is no fear of remaining any flaw on the slidable contact surface 3*b*.

Although several embodiments have been described, they are merely exemplary of the invention and not to be construed as limiting, the invention being defined solely by the appended claims.

What is claimed is:

1. A scroll type fluid apparatus provided with a fixed scroll, an orbiting scroll, a housing for fixing said fixed scroll, a thrust bearing for supporting said orbiting scroll rotatably to said housing, a crankshaft having an eccentric shaft for driving said orbiting scroll, and a rotation preventing mechanism for preventing said orbiting scroll from rotating by itself, said rotation preventing mechanism comprising a bearing portion provided at the rear side of said orbiting scroll, having a receiving portion for receiving therein said eccentric shaft, and formed to be square at the outer surface; a sliding member having inner surfaces engageable with two opposite outer surfaces at said bearing portion to regulate radial movement of said bearing portion in reciprocating movement, and formed to be square at the outer surface; and a holder for said sliding member, which has inner surfaces engageable with two opposite outer surfaces at said sliding member to regulate movement of said sliding member in the direction perpendicular to said moving direction of said bearing portion; said crankshaft being provided with lubrication means for lubricating said bearing portion, said rotation preventing mechanism being provided before and behind said sliding member in the sliding direction thereof with oil chambers tightly sealed and variable in volume due to the sliding motion of said sliding member, said bearing portion and sliding member being provided with connection means for connecting said oil chambers to said lubrication means, said thrust bearing being provided with communication means for communicating the slidable contact surface of said orbiting scroll with respect to said thrust bearing with said oil chambers.

2. A scroll type fluid apparatus according to claim 1, wherein one of the slidable contact surface at said thrust bearing with respect to said orbiting scroll and the slidable contact surface at said orbiting scroll with respect to said thrust bearing is provided with a plurality of oil sumps having conical surfaces respectively .

3. A scroll type fluid apparatus according to claim 1, wherein said connection means and communication means are provided with oil-feeding passages, and between said sliding member and said holder therefor are provided restriction mechanisms each suppressing a flow of oil from said oil-feeding passages at said communication means to said oil-feeding passages at said connecting means when said oil chambers decrease in volume by sliding motion of said sliding member.

4. A scroll type fluid apparatus according to claim 3, wherein said oil-feeding passages at said communication means are disposed at said oil chambers and at both lateral sides in the moving direction of said sliding member respectively, said oil-feeding passages of said connection means at said sliding member are disposed at the centers of both lateral sides in the moving direction of said sliding member, said restriction mechanisms being adapted to be formed between the outer surfaces in front and in the rear of said sliding member in the moving direction thereof and the inner surfaces at said holder for said sliding member opposite to said outer surfaces respectively.

5. A scroll type fluid apparatus according to claim 4, wherein said sliding member is provided at both lateral sides thereof in the moving direction of said sliding member with cutouts respectively, said oil-feeding passages at said communication means facing between said cutouts and said inner surfaces of said holder for said sliding member corresponding to said cutouts respectively.

6. A scroll type fluid apparatus according to claim 1, wherein said rotation preventing mechanism comprises a sliding member holder having inner surfaces for regulating sliding movement of said sliding member in a direction perpendicular to a direction of movement of said bearing portion and a closing means for closing spaces formed between said sliding member and said sliding member holder and before and behind said sliding member in its direction of sliding movement such that said spaces form said oil chambers which are tightly sealed and variable in volume due to said sliding movement of said sliding member.

7. A scroll type fluid apparatus according to claim 6, wherein said sliding member holder is integral with said thrust bearing.

* * * * *